US005717562A

United States Patent [19]

Antone et al.

[11] Patent Number: 5,717,562

[45] Date of Patent: Feb. 10, 1998

[54] SOLENOID INJECTOR DRIVER CIRCUIT

[75] Inventors: James A. Antone, Edwards; Kenneth D. Gihring, Peoria; Errol W. Davis, Chillicothe, all of Ill.

[73] Assignee: Caterpillar Inc., Peoria, Ill.

[21] Appl. No.: 720,994

[22] Filed: Oct. 15, 1996

[51] Int. Cl.[6] ..... H01H 47/00

[52] U.S. Cl. ..... 361/155; 361/159; 361/187; 361/190

[58] Field of Search ..... 361/152, 154, 361/155, 156, 159, 170, 187, 189, 190

[56] References Cited

U.S. PATENT DOCUMENTS

| | | | |
|---|---|---|---|
| 4,604,674 | 8/1986 | Pflederer | 361/155 |
| 4,618,908 | 10/1986 | Anttila | 361/187 |
| 4,764,840 | 8/1988 | Petrie et al. | 361/154 |
| 4,862,866 | 9/1989 | Calfus | 123/490 |
| 5,053,911 | 10/1991 | Kopec et al. | 361/154 |
| 5,442,515 | 8/1995 | Wallaert | 361/187 |
| 5,541,806 | 7/1996 | Hoffman | 361/160 |
| 5,574,617 | 11/1996 | Shimanuki et al. | 361/154 |

*Primary Examiner*—Jeffrey A. Gaffin
*Assistant Examiner*—Michael Sherry
*Attorney, Agent, or Firm*—R. Carl Wilbur

[57] ABSTRACT

A solenoid driver circuit is controlled by an electronic control module ("ECM") and eliminates many components required for a high voltage power supply required by the prior art. The solenoid driver circuit includes a high voltage select switch, a select switch and a modulation switch that are controlled by the ECM. The ECM causes the switches to be opened and closed so that the back EMF created by the solenoid coil when the modulation switch is opened can be recaptured by charging a capacitor. That energy can then be used to energize the solenoid coil.

11 Claims, 6 Drawing Sheets

PRIOR ART

SOLENOID INJECTOR DRIVER CIRCUIT

TECHNICAL FIELD

This invention relates generally to a solenoid driver circuit, and more particularly, to an energy saving solenoid driver circuit which recovers the power normally dissipated by the current flyback path in a conventional solenoid driver.

BACKGROUND ART

Many types of actuators use solenoids to create a magnetic field to act on and thereby cause movement in the actuator. Examples of such solenoid actuators include fuel injectors, valve actuators and others. The problems associated with electronically controlling fuel injectors is typical of the problems encountered in controls of other types of solenoid actuators. The problems of the prior art discussed hereinafter, although specifically addressed to fuel injectors, apply more broadly, to solenoid actuators in general.

In the field of electronically controlled fuel injection systems, it is imperative that electromagnetic solenoids be provided which are capable of high speed operation and have consistently reproducible stroke characteristics. The necessity of high speed operation requires little explanation when one considers that an engine operating at 2000 rpm could require fuel to be injected into each cylinder of a multi-cylinder engine at 10 millisecond intervals and the entire injection pulse could be as short as one millisecond. Slow acting solenoids result in erroneous quantities of fuel being delivered to each cylinder at an inappropriate timing advance which can adversely affect the performance of the engine.

High speed solenoid operation is obviously an absolute necessity; however, the need for consistently reproducible stroke characteristics is a less obvious but equally important requirement. A reproducible solenoid stroke provides the precise control needed to obtain maximum fuel efficiency, power output, and engine life and also improves exhaust emissions. These benefits extend from the fact that the quantity of fuel injected into a cylinder is typically controlled by the duration of time for which the fuel injector is maintained in an open configuration. To control the engine accurately, a fixed voltage applied to the solenoid for a fixed duration of time must result in the solenoid opening the injector for a substantially standard duration of time to thereby deliver a standard preselected quantity of fuel. Once the relationship between voltage, time, and quantity of fuel has been established, it should remain constant throughout the useful life of the apparatus. Therefore, a fuel injection solenoid control can provide advantageous control of engine operation over the entire range of engine speeds by delivering a regulated voltage for a variable duration of time. Typically, the rise time of current flow through the solenoid is a function of the voltage applied. The reproducibility of the stroke characteristics versus control signal applied to the solenoid improves with higher voltages applied to the solenoid. However, higher voltages typically require high voltage supplies that add to the expense of the overall driver circuit.

Further, in the operation of a fuel injection system on a multi-cylinder engine, a fuel injection solenoid is provided for each engine cylinder and must be energized and de-energized for each compression stroke of the corresponding engine cylinder. Typically, the energy stored in the solenoid is transformed into heat by a diode and resistor combination placed in the flyback current path of each solenoid. The magnitude of the energy disposed of in this manner is significant and directly results in an increase to the cost of the system. The heat generated by the discharging solenoids exacerbates the problem of heat dissipation in an already thermally hostile environment. Additional means must be provided to remove the excess heat to maintain the reliability of the electronic hardware. Increased heat dissipation capability is a directly measurable cost. Additionally, significantly greater power generating capability is necessary than would be if a portion of the stored energy could be recovered.

U.S. Pat. No. 4,604,675 issued to Pflederer addresses some of the above drawbacks associated with the prior art solenoid drivers. However, even the device disclosed in Pflederer does not completely eliminate the requirement for a dedicated high voltage power supply to drive the injector solenoids. Furthermore, the device in Pflederer only partially recovers the energy stored in the solenoid coil. The device only recovers energy stored in the solenoid coils during the transition from the pull-in to the hold-in current level and from the hold-in level to zero. During times when the device is modulating current to maintain the desired pull-in and hold-in current levels energy is simply dissipated through the flyback current path.

The present invention is directed to overcoming one or more of the drawbacks associated with the prior art as set forth above.

SUMMARY OF THE INVENTION

It is an object of one aspect of the present invention to provide a solenoid driver circuit that provides the advantages of a high voltage solenoid driver while eliminating many of the circuit components of the high voltage power supply traditionally associated with such high voltage solenoid drivers.

Still another object of the present invention is to provide a solenoid driver that recaptures solenoid coil energy (back EMF) when power is disconnected from the solenoid coil.

These and other objects and advantages of the present invention will become apparent upon reading the detailed description of a preferred embodiment in connection with the drawings and the appended claims.

DETAILED DESCRIPTION OF THE BEST MODE OF A PREFERRED EMBODIMENT

The following is a detailed description of the best mode of a preferred embodiment of the present invention. The present invention relates to a control for use with on/off solenoid actuators. Although the preferred embodiment is described in connection with solenoid actuators used in fuel injectors, it has application outside that art. More specifically, the present invention is advantageous in those actuator applications where it is important to control the current rise time through the solenoid coil. These applications typically require a high voltage supply to decrease the duration of the initial rise time. The present invention provides a high voltage supply without having a dedicated high voltage power supply circuit.

Thus, although a preferred embodiment of the present invention is described in connection with fuel injectors, it is not limited to the single application described herein. On the contrary, the present invention includes all alternative embodiments and equivalents that fall within the scope of the appended claims.

Figure 1:
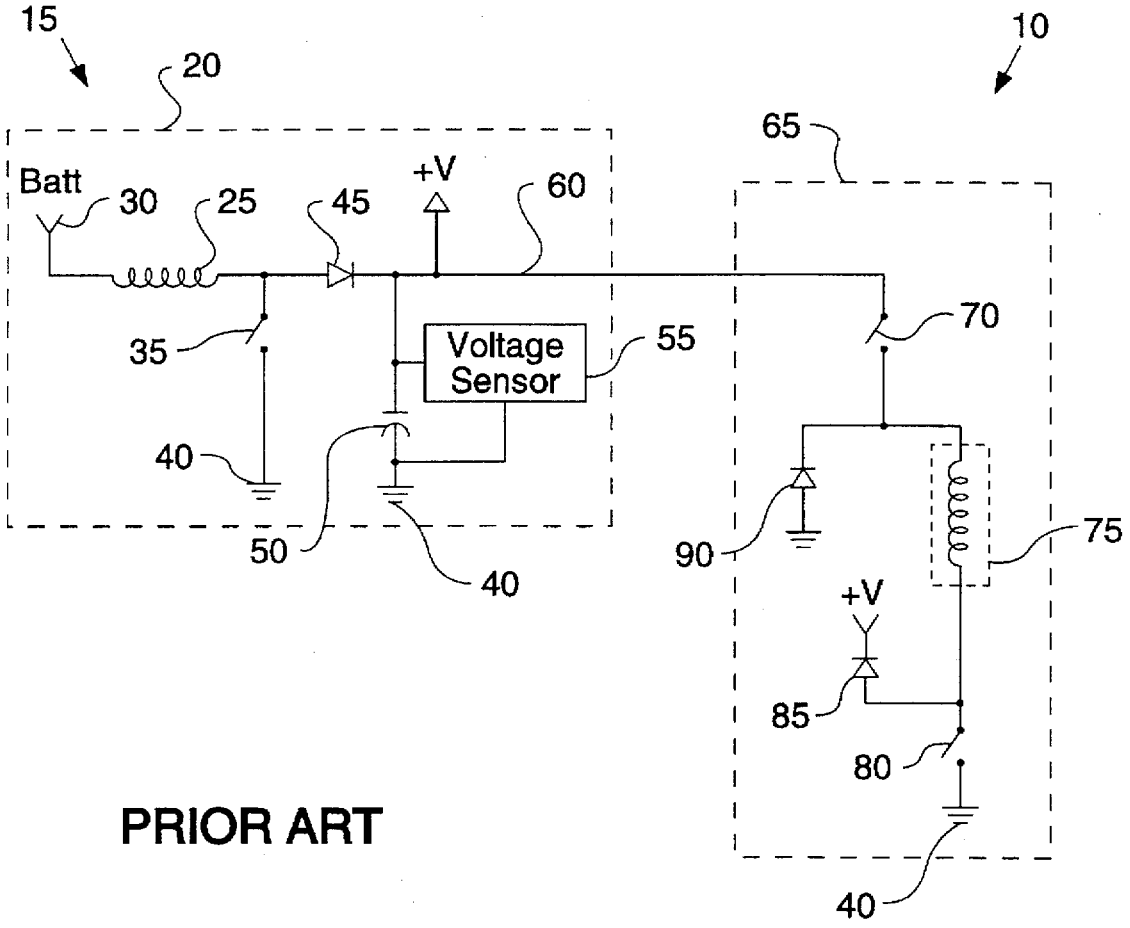
FIG. 1 illustrates a schematic of a typical solenoid driver known in the prior art.

Referring first to FIG. 1, a schematic circuit diagram of a typical prior art high voltage fuel injector solenoid driver circuit 10 is shown. The driver circuit 10 generally includes a high voltage power supply 15, which in the drawing is shown generically as a boost converter 20. As is known to those skilled in the art, a boost converter 20 generally includes an inductor 25 connected to a low voltage power supply, which in engine applications is typically a battery voltage 30. A switch 35 is connected in series with the inductor 25 to ground 40. The anode of a diode 45 is connected to the inductor 25 and the switch 35. The cathode of the diode 45 is connected to a high voltage capacitor 50 and the capacitor voltage will be controlled by sensing the voltage across the capacitor by voltage sensor 55. Typically the voltage sensor will include a voltage divider or other similar device to scale the capacitor voltage appropriately for an electronic controller or other measuring device that receives the voltage signal.

As is known to those skilled in the art, the boost converter 20 produces a high voltage output on line 60 (i.e., the voltage stored across the high voltage capacitor 50) by modulating the switch 35 between an open and a closed position. As is known to those skilled in the art, stopping current flow through an inductor creates a voltage potential known as back EMF. A boost converter such as the one shown in FIG. 1, takes advantage of that voltage to charge the capacitor 50 to a higher voltage level than the voltage output of the low voltage power supply, in this case the battery 30. Thus, in FIG. 1 an electronic controller (not shown) or other device will typically monitor a voltage signal produced by the voltage sensor 55, which indicates the voltage level on line 60, and control modulation of the switch 35 to produce a voltage across the inductor at times when the switch is opened. The capacitor voltage is monitored and the inductor 25 is used to charge the capacitor 50 repeatedly to maintain the voltage output at the desired voltage level.

A typical fuel injector solenoid control circuit 65 is generally shown in FIG. 1 in relation to the high boost converter 20. Although a single injector solenoid control circuit 65 is shown in FIG. 1, additional such circuits are typically included in parallel, each such circuit controlling a single injector. Thus, in a six cylinder engine, there are typically six such circuits. Included in the control circuit 65 is a select switch 70 which is used in applications involving more than one injector to determine which of the injector solenoids will be energized. The select switch 70 is connected in series to the solenoid coil 75 which in turn is connected to ground 40 through a modulation switch 80. The modulation switch 80 is controlled by an electronic controller to control current flow through the solenoid coil 75, by controlling the duration of time the voltage on line 60 is applied across the solenoid coil 75. When the modulation switch 80 opens, current will dissipate through the coil resistance and a flyback diode 85, coil 75 and slightly recharge the capacitor 50. Thus, the rate of current decay will be a function of the resistance of the solenoid coil 75 and the voltage drop across the diode 85.

Figure 2:
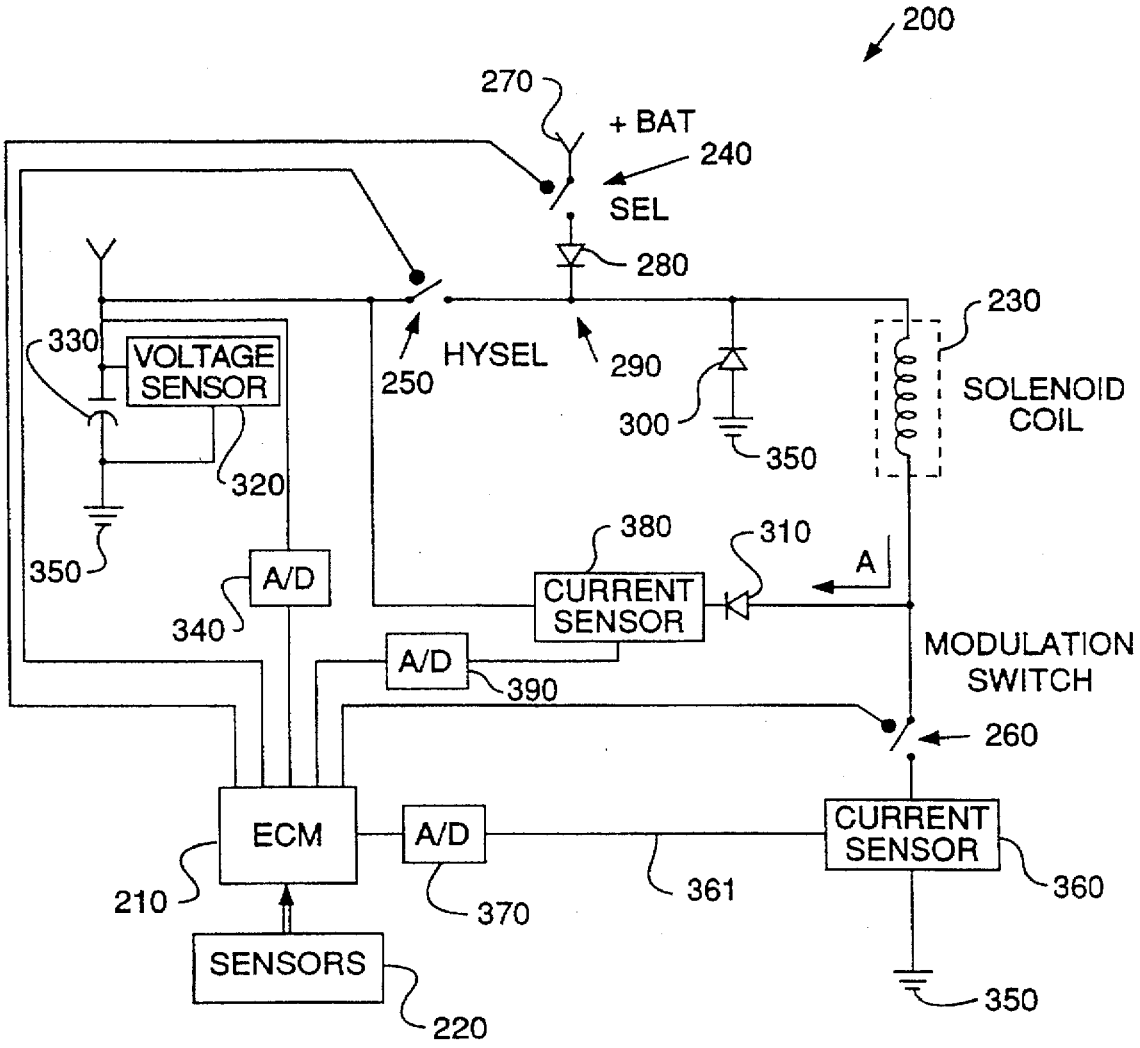
FIG. 2 illustrates a schematic diagram of a preferred embodiment of the solenoid driver circuit of the present invention.

Referring now to FIG. 2, a schematic circuit diagram of the best mode of a preferred embodiment of the solenoid driver circuit 200 of the present invention is shown. FIG. 2 illustrates the implementation of a preferred embodiment in connection with a single solenoid coil. The present invention, however, is not limited to use with a single coil. To the contrary, the present solenoid driver circuit may include additional solenoid coils in parallel with the one shown in FIG. 2. In such an embodiment, each solenoid coil would preferably be connected to a common select switch 240, a common first diode 280 and its own modulation switch 260. The modulation switch 260 will then be selectively activated to designate which of the solenoid coils will be energized. As can be seen from the drawing, many of the components of the high voltage power supply 15 of FIG. 1 have been eliminated. Nevertheless, as is fully described below, the solenoid driver circuit 200 achieves the advantages of the circuit shown in FIG. 1 without requiring many of the dedicated components of the high voltage supply circuit. For example, the dedicated inductor 25, switch 35 and diode 45 are not required in the circuit of FIG. 2.

As shown in FIG. 2, the solenoid driver circuit 200 is controlled by an electronic control module (ECM) 210. In a preferred embodiment, the ECM includes a microprocessor model No. MC68HC11, manufactured by Motorola, Inc., headquartered in Schaumburg, Ill. As is known to those skilled in the art, there are signal conditioning, interface, and power circuits, among other standard circuits, associated with the use of such a microprocessor. A person of ordinary skill in the art could readily and easily implement such standard circuits in connection with a suitable microprocessor without undue experimentation. Although a preferred embodiment of the present invention includes the microprocessor designated above, many other suitable microprocessors can be used in connection with the present invention.

Sensors 220 are shown connected to the ECM. These sensors 220 may include, for example, in the present embodiment, an engine speed sensor, a crankshaft position sensor, a throttle position sensor, and various switches controlling the application of cruise control, PTO and other functions. In solenoid driver applications other than fuel injectors, other sensor inputs may be received. The ECM 210 receives these various signals and calculates a current command voltage that corresponds to a desired current level. The solenoid driver circuit 200 then controls current to the desired level. The ECM 210 also calculates the time when the current command signal is issued based on the various sensor inputs. In engine applications, timing and duration of the fuel injection signal are determined in connection with the specific engine hardware configurations being used. Those calculations are known to those skilled in the art and are beyond the scope of the present invention. Thus, those calculations are not explained further herein. In an alternative embodiment, the ECM 210 could receive the current command signal from another component. A complete description of the solenoid driver circuit is response to the current command is described below with reference to FIG. 3 and FIG. 4*a–b*.

As shown in FIG. 2 the ECM 210 is connected to, and controls the opening and closing of, a select switch 240, a high voltage select switch 250, and a modulation switch 260. In the drawing these switches are shown as ideal switches. However, in a preferred embodiment these switches include MOSFETS(Metal-Oxide field effect transistors) to control the flow of current according to a command from the ECM 210. Although a preferred embodiment uses field effect transistor, other current control devices, including relays or other types of transistors, could be used without deviating from the scope of the present invention as defined by the appended claims.

The select switch 240 is connected between a low voltage source, which in the preferred embodiment is battery voltage 270, and a first diode 280. The first diode 280 is connected to a junction 290, which includes one terminal of the high voltage select switch 250, the cathode of a second diode 300 and one terminal of the solenoid coil 230. The second terminal of the high voltage select switch 250 is connected to the cathode of a third diode 310 and to a voltage sensor 320. The voltage sensor 320 is connected to a high voltage capacitor 330 which is connected to ground 350. In a preferred embodiment, the voltage sensor 320 includes a voltage divider or other similar device or circuitry to scale the voltage across the high voltage capacitor 330 to an appropriate level for an analog to digital converter 340 which then converts the analog voltage signal to a corresponding digital value to be read by the ECM 210.

The ECM 210 is also connected to a first current sensor 360. In a preferred embodiment the first current sensor 360 is placed in series with the modulation switch 260 and ground 350. The first current sensor 360 produces a current signal on connector 361. A second analog to digital converter 370 receives the current signal and converts the analog current signal to a digital value which is then read by the ECM 210. Although the drawing shows the analog to digital converter 340 and the second analog to digital converter 370 as distinct, it should be recognized that these two functions typically are combined in a single electrical component, for example a four channel A/D converter. Furthermore, although an analog to digital converter 370 is shown in FIG. 2, other types of interface components or circuits could be substituted without deviating from the scope of the invention as defined by the appended claims. The ECM 210 is preferably connected to a second current sensor 380 through third analog to digital converter 390. Typically, the third analog to digital converter will be included in the four channel A/D converter or similar component described above.

Although the preferred embodiment includes a second current sensor 380, an alternative embodiment that eliminates the second current sensor 380 can be used while still achieving the advantages of the present invention. Such a device falls within the scope of the appended claims. As described in more detail below, the second current sensor 380 is necessary for the ECM 210 to be able to sense current flow accurately through the solenoid coil 230 at all times. For example, when the ECM 210 causes the modulation switch 260 to open, current flowing through the solenoid coil 230 will no longer flow through the current sensor 360. Thus the current sensor 360 will produce a current signal indicating approximately zero current flow through the solenoid coil 230. However, when the modulation switch 260 opens, current will continue to flow through the flyback path generally represented by the arrow in FIG. 2 labeled A. Thus, when the modulation switch 260 is opened, the second current sensor 380 will sense the flyback current, and produce a signal indicative of that current. The current signal from the second current sensor 380 will permit the ECM to sense current flow through the solenoid coil 230 when the modulation switch 260 is open.

In some applications, however, it may be possible to eliminate the second current sensor 380. In those applications, without the second current sensor 380, the ECM 210 is unable to sense actual current flow through the solenoid coil 230 when the modulation switch 260 is open. However, by calculating or otherwise approximating the rate at which current decays through the coil and the associated flyback path (arrow A), the ECM can approximate the appropriate time when the modulation switch 260 should be kept open before turning on again to maintain a desired current flow through the solenoid coil 230. This alternative embodiment could be used to approximate the performance of the device of FIG. 2 while eliminating the requirement for the second current sensor 830.

There are several modes of operation of the solenoid driver circuit 200. The first mode is an initialization mode. The solenoid driver circuit 200 must be initialized whenever the solenoid driver has been disconnected from the low battery supply for an extended period of time or the capacitor has otherwise discharged below a desired voltage. In this case, prior to issuing a current command, the ECM 210 must initialize the system to charge the capacitor 330. The second mode is a normal operation mode.

I. Initialization Mode

The ECM 210 will begin an initialization mode when the capacitor 330 voltage level, as measured by the voltage sensor 320, falls below a tolerance value of a desired capacitor voltage $V_{capp}$. Thus, if the capacitor voltage level is less than the desired voltage $V_{capp}$ minus the tolerance value, then the ECM 210 will begin an initialization sequence.

Figure 3:
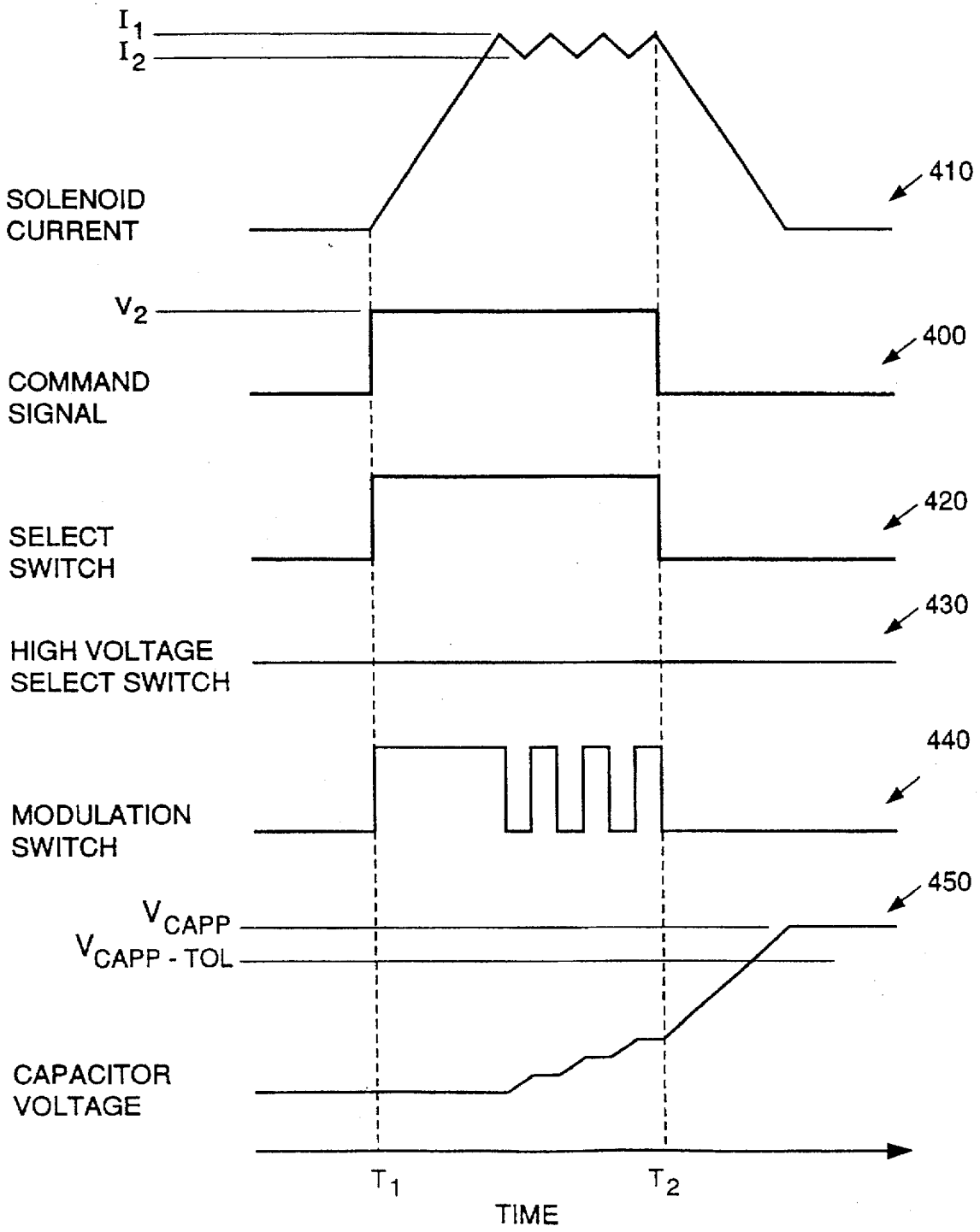
FIG. 3 illustrates a general timing diagram for an initialization mode used in connection with an embodiment of the present invention; and FIG. **4*a* and 4*b*** illustrate a general timing diagram for a normal mode used in connection with an embodiment of the present invention.

Referring first to FIG. 3, a timing diagram of the initialization mode is shown, including the general timing relationship among the various electrical currents, voltages and signals, in a preferred embodiment of the present invention. As shown in FIG. 3, the capacitor voltage level 450 starts out below the voltage level $V_{capp}$–(Tol), which might occur when the solenoid driver circuit 200 is first turned on after a period of not being used. The ECM 210 issues a command signal at a second voltage level $V_2$ corresponding to a desired solenoid current $I_1$. As noted above, the present invention relates generally to on/off solenoid actuators as opposed to proportional solenoid actuators. In a preferred embodiment, the desired solenoid current $I_1$, is less than the solenoid coil 230 requires to cause the actuator to move to the "on" position. As shown in the figure, at the time $T_1$ the current command signal 400 transitions to the second voltage level $V_2$ corresponding to a desired current level $I_1$. The ECM 210 also produces a first control signal 420 on an electrical connector connected to the select switch 240, thereby causing the switch to close. The ECM 210 also produces a third control signal 440 on the electrical connector connected to the modulation switch 260, which causes the modulation switch 260 to close. As a result, the battery voltage 270 is connected to the solenoid coil 230 thereby causing current to flow through the coil 230. As shown in FIG. 3, current flow through the solenoid coil 230 increases until the current level reaches a first predetermined current level $I_1$.

The ECM 210 monitors the current signal produced by the current sensor 360 on connector 361. When the current through the solenoid coil reaches $I_1$, the ECM 210 discontinues the third control signal 440 thereby causing the modulation switch 260 to open. The solenoid coil 230 generates back EMF causing current to continue to flow along a path indicated by arrow A in FIG. 2, through the third diode 310, the second current sensor 380, the voltage sensor 320 and charging the high voltage capacitor 330. As the capacitor 330 charges, the current level though the solenoid coil 230 decreases. The ECM 210 monitors the current signal produced by the current sensor 380 and when the current signal indicates a current flow through the solenoid coil 230 that is less than a second predetermined current level $I_2$, the ECM produces the third control signal 440 thereby causing the modulation switch 260 to close. In a preferred embodiment, the second predetermined current level $I_2$, is a preselected tolerance less than the first predetermined level $I_1$. The ECM 210 thereafter modulates the production of the third control signal thereby causing the modulation switch 260 to modulate between an open position when the current flow through the solenoid coil 230 exceeds the first predetermined level $I_1$, and a closed position, when the current through the solenoid coil 230 is less than the second predetermined current level $I_2$. In this way the current through the solenoid coil modulates between the current levels of the first predetermined level $I_1$ and the second predetermined current level $I_2$ while the current command signal is at the voltage level $V_2$.

The ECM 210 continues modulating the current between the first predetermined level $I_1$ and the second predetermined current level $I_2$ until the voltage level across the capacitor 330 exceeds the desired capacitor 330 voltage level $V_{capp}$. When the capacitor is charged to the desired voltage level $V_{capp}$, then the command signal transitions to zero at time $T_2$. The ECM 210 the discontinues producing both the first control signal 420 and the third control signal 440 and, as a result, the select switch 240 and the modulation switch 260 are in an open position. The voltage resulting from the back EMF in the solenoid coil 230 causes current to continue to flow and is used to charge the high voltage capacitor 330. In this manner, the current through the solenoid coil 230 decays from the current levels determined by the modulation of the current between the first predetermined level $I_1$ and the second predetermined current level $I_2$ to zero.

Because the preferred embodiment of the present invention uses the battery voltage 270 to supply current to the solenoid coil 230 during the modulation of the current between the first predetermined level $I_1$ and the second predetermined current level $I_2$ and because the voltage created by back EMF of the solenoid coil 230 is used to charge the high voltage capacitor 330, the system 200 is able to charge the capacitor 330 to a desired voltage level $V_{capp}$ and maintain the capacitor 330 at the desired voltage level $V_{capp}$ without the dedicated high power supply components of the prior art. The desired voltage level $V_{capp}$ is preferably a higher voltage than the battery 270 voltage to achieve improved response time and improved repeatability. Also, because the current levels $I_1$ and $I_2$ are less than is required for the injector to open, no fuel is injected by these signals. Instead, the injector solenoid coil is used as an energy storage device to charge the high voltage capacitor.

II. Normal Operational Mode

Figure 4A:
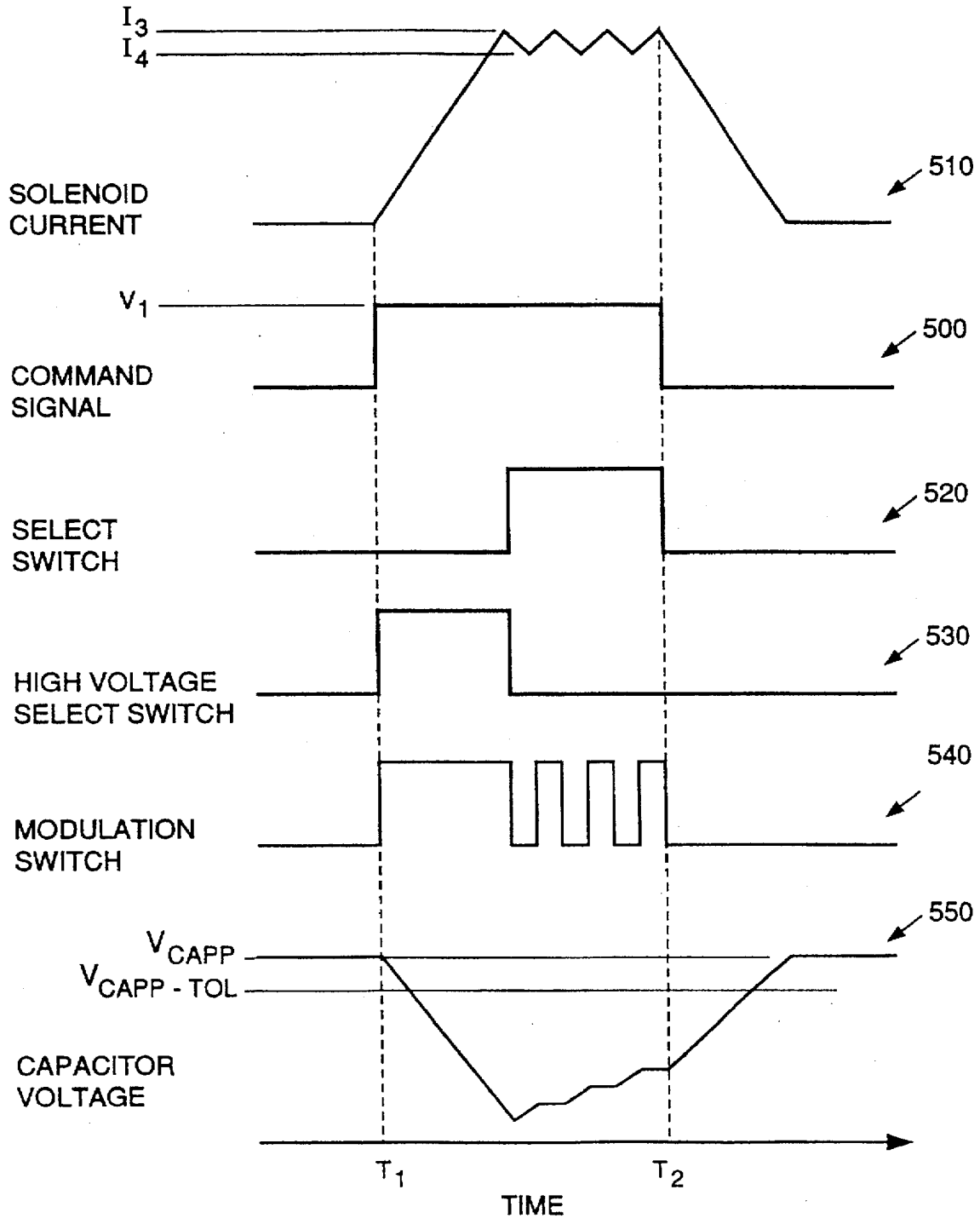

The ECM 210 operates under the normal operation mode once it has verified that the voltage level across the high voltage capacitor 330, as measured by the voltage sensor 320, is within the predetermined tolerance (Tol) of the desired voltage level $V_{capp}$. Referring now to FIG. 4*a*, a representative timing diagram for a preferred embodiment of the solenoid driver 200 of the present invention is shown as it operates in the normal operational mode. The drawing shows, among other current levels, voltage levels, and signals, the relationship between a representative current command signal 500 and the solenoid current 510. At a time $T_1$ the current command signal 500 transitions to a predetermined voltage level $V_1$ corresponding to a third desired current level $I_3$. When the ECM 210 produces the command signal 500, the ECM 210 also produces a second control signal 530 on an electrical connector connected to the high voltage select switch 250, thereby causing the switch 250 to close, and a third control signal 540 on the electrical connector connected to the modulation switch 260, thereby causes the modulation switch 260 to close. As a result, the high voltage capacitor 330 is connected to the solenoid coil 230 thereby causing current to flow through the coil 230. As shown in FIG. 4*a*, current flow through the solenoid increases until the current level reaches a third predetermined current level $I_3$.

The ECM 210 monitors the current signal produced by the current sensor 360 on connector 361. When the current through the solenoid coil reaches $I_3$, the ECM 210 discontinues the second control signal 530 and the third control signal 540 thereby causing the high voltage select switch 250 and the modulation switch 260 to open. At about the same time, the ECM produces the first control signal 520 thereby causing the select switch 240 to close. As a result of the modulation switch 260 being opened, the solenoid coil 230 generates back EMF causing current to continue to flow along the path indicated by arrow A in FIG. 2, through the third diode 310, the second current sensor 380, the voltage sensor 320 and charges the high voltage capacitor 330. As the capacitor 330 charges, the current level though the solenoid coil 230 decreases. The ECM 210 monitors the current signal produced by the current sensor 380 and when the current signal indicates a current flow through the solenoid coil 230 that is less than a fourth predetermined current level $I_4$, the ECM 210 produces the third control signal 540 thereby causing the modulation switch 260 to close. In a preferred embodiment, the fourth predetermined current level $I_4$, is a preselected tolerance less than the third predetermined level. As shown in FIG. 2, when the select switch 240 and the modulation switch are closed, the battery voltage 270 is applied across the solenoid coil 230, thereby increasing the current flow through the coil 230. The ECM 210 thereafter modulates the production of the third control signal 540 thereby causing the modulation switch 260 to modulate between an open position when the current flow through the solenoid coil 230 exceeds the third predetermined level $I_3$ and closed position when the current through the solenoid coil 230 is less than the fourth predetermined current level $I_4$. In this way the current through the solenoid coil modulates between the current levels of the third predetermined level $I_3$ and the fourth predetermined current level $I_4$ while the current command signal is at the voltage level $V_1$.

During this period of modulation, the back EMF created by the solenoid coil 230, when the modulation switch 260 is opened, is used to charge the capacitor 330. As shown in FIG. 4*a*, the capacitor voltage 550 begins within a predetermined tolerance (Tol) of the desired voltage level $V_{capp}$. As noted above, during the period when the ECM 210 produces the second control signal 530 and the third control signal 540, the capacitor voltage 550 is applied across the solenoid coil 230. As a result, the capacitor voltage drops as current begins to flow through the coil 230. However, when the current level initially reaches the third predetermined current level $I_3$, the ECM 210 thereafter connects the battery to the solenoid coil and uses the back EMF to re-charge the capacitor 330. Thus, the timing diagram of FIG. 4*a* shows that the capacitor voltage 550 increases during each period when the third control signal 540 is discontinued thereby opening the modulation switch 260. The capacitor 330 continues to recharge until the capacitor voltage exceeds the desired voltage $V_{capp}$ or the command signal is discontinued and current is no longer flowing through the solenoid coil 230. As shown in FIG. 4*a*, the capacitor voltage 550 continues to increase until the current no longer flows through the solenoid coil 230. In some instances, as is fully explained below with reference to FIG. 4*b*, the capacitor voltage 550 may exceed the desired voltage level $V_{capp}$ at which time the capacitor may again be used to drive the solenoid coil until the voltage level drops to within a desired level of $V_{capp}$.

When the command signal 500 voltage level transitions to zero at time $T_2$, the ECM 210 discontinues producing both the first control signal 520 and the third control signal 540 and, as a result, the select switch 240, the high voltage select switch 250 and the modulation switch 260 are all in an open position. The voltage resulting from the back EMF in the solenoid coil 230 causes current to continue to flow in a direction generally shown by arrow A in FIG. 2. The back EMF current is used to charge the high voltage capacitor 330. In this manner, the current through the solenoid coil 230 decays from the current levels determined by the modulation of the current between the third predetermined level $I_3$ and the fourth predetermined current level $I_4$ to zero.

Because the preferred embodiment of the present invention uses the battery voltage 270 to supply current to the solenoid coil 230 during the modulation of the current between the third predetermined level $I_3$ and the fourth predetermined current level $I_4$ and because the current created by back EMF is used to charge the high voltage capacitor 330, the system 200 is able to maintain the voltage of the high voltage capacitor 330 at a desired level. The desired level is preferably a higher voltage than the battery 270 voltage to achieve improved response time and improved repeatability.

Figure 4B:
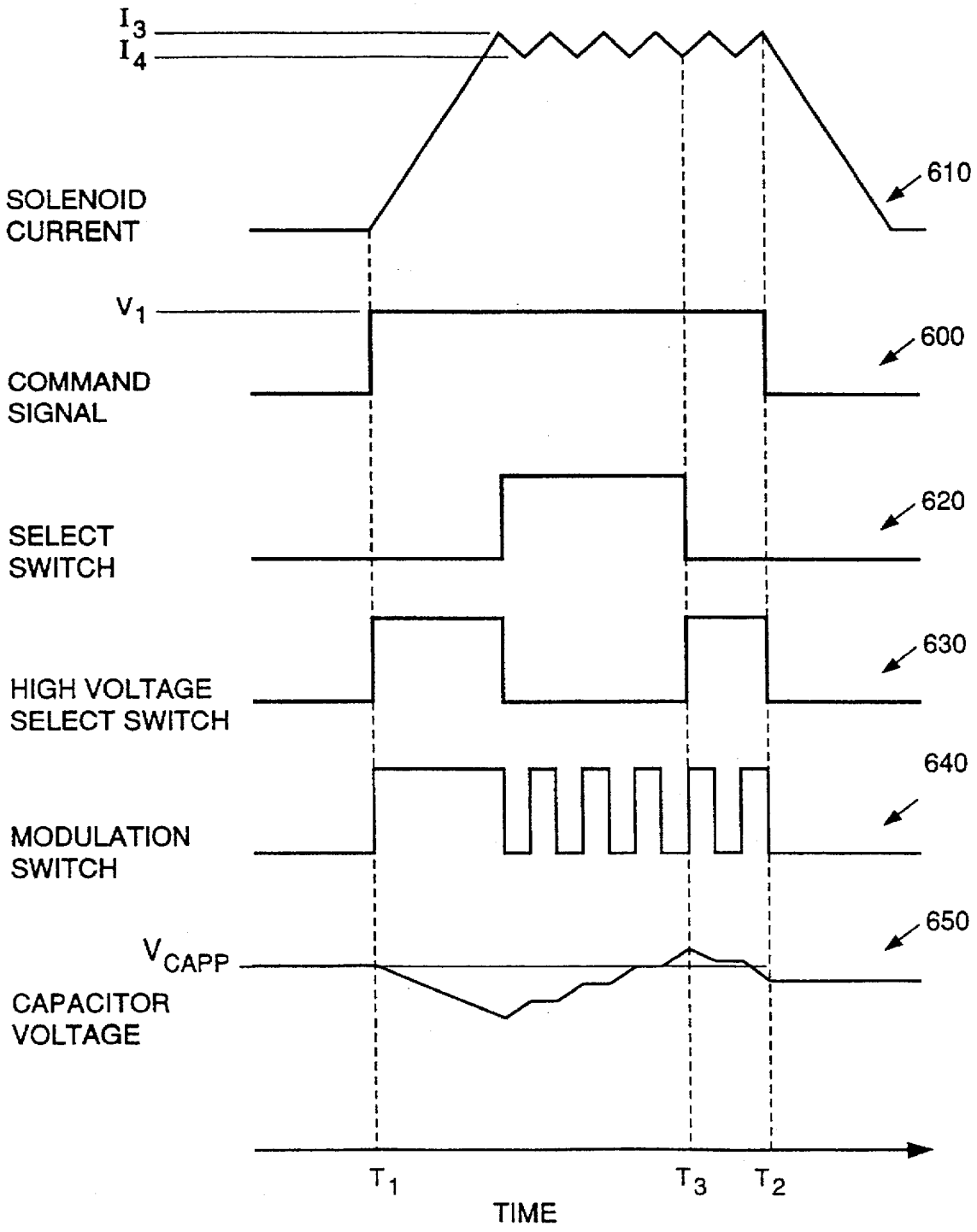

Referring now to FIG. 4*b*, a timing diagram of a preferred embodiment of the present invention is shown in which the capacitor 330 is charged to a voltage level 650 exceeding the desired voltage level $V_{capp}$. As described above, in the normal operational mode, the ECM 210 has verified that the voltage level across the high voltage capacitor 330, as measured by the voltage sensor 320, is within the predetermined tolerance (Tol) of the desired voltage level $V_{capp}$. At the time $T_1$ the current command signal 600 transitions to a predetermined voltage level $V_1$ corresponding to a third desired current level $I_3$. When the ECM 210 produces the command signal 600, the ECM 210 also produces a second control signal 630 on an electrical connector connected to the high voltage select switch 250, thereby causing the switch 250 to close, and a third control signal 640 on the electrical connector connected to the modulation switch 260, which causes the modulation switch 260 to close. As a result, the high voltage capacitor 330 is connected to the solenoid coil 230 thereby causing current to flow through the coil 230. As shown in FIG. 4*b*, current flow through the solenoid increases until the current level reaches a third predetermined current level $I_3$.

The ECM 210 monitors the current signal produced by the current sensor 360 on connector 361. When the current through the solenoid coil reaches $I_3$, the ECM 210 discontinues the second control signal 630 and the third control signal 640 thereby causing the high voltage select switch 250 and the modulation switch 260 to open. At about the same time, the ECM 210 produces the first control signal 620 thereby causing the select switch 240 to close. As a result of the modulation switch 260 opening, the solenoid coil 230 generates back EMF causing current to continue to flow. Generally along the path indicated by arrow A in FIG. 2, through the third diode 310, the second current sensor 380, the voltage sensor 320 and charges the high voltage capacitor 330. As the capacitor 330 charges, the current level though the solenoid coil 230 decreases. The ECM 210 monitors the current signal produced by the current sensor 380 and when the current signal indicates a current flow through the solenoid coil 230 that is less than a fourth predetermined current level $I_4$, the ECM 210 produces the third control signal 640 thereby causing the modulation switch 260 to close. In a preferred embodiment, the fourth predetermined current level $I_4$, is a preselected tolerance less than the third predetermined level. As shown in FIG. 2, when the select switch 240 and the modulation switch 260 are closed, the battery voltage 270 is applied across the solenoid coil 230, thereby increasing the current flow through the coil 230. The ECM 210 thereafter modulates the production of the third control signal 640 thereby causing the modulation switch 260 to modulate between an open position when the current flow through the solenoid coil 230 exceeds the third predetermined level $I_3$ and closed position when the current through the solenoid coil 230 is less than the fourth predetermined current level $I_4$. In this way the current through the solenoid coil modulates between the current levels of the third predetermined level $I_3$ and the fourth predetermined current level $I_4$ while the current command signal is at the voltage level $V_1$.

During this period of modulation, the back EMF created by the solenoid coil 230, when the modulation switch 260 is opened, is used to charge the capacitor 330. As shown in FIG. 4*b*, the capacitor voltage 650 begins within a predetermined tolerance (Tol) of the desired voltage level $V_{capp}$. As noted above, during the period when the ECM 210 produces the second control signal 630 and the third control signal 640, the capacitor voltage 650 is applied across the solenoid coil 230. As a result, the capacitor voltage 650 drops as current begins to flow through the coil 230. However, when the current level initially reaches the third predetermined current level $I_3$, the ECM 210 thereafter connects the battery to the solenoid coil 230 and uses the back EMF to re-charge the capacitor 330. Thus, the timing diagram of FIG. 4*b* shows that the capacitor voltage 650 increases each time third control signal 640 is discontinued thereby opening the modulation switch 260. In FIG. 4*b*, the capacitor voltage 650 continues to increase until time $T_3$ when the capacitor voltage exceeds the desired voltage $V_{capp}$. When this happens, the ECM 210 discontinues the first control signal 620 and produces the second control signal 630, thereby opening the select switch 240 and closing the high voltage select switch 250, respectively. As shown in FIG. 4*b*, at time $T_3$ when the capacitor 330 is connected to the solenoid coil 230, the capacitor voltage 650 decreases because it is supplying current to the solenoid coil 230. Then ECM 210 continues to produce the second control signal 630 until the capacitor voltage falls below the desired voltage $V_{capp}$ less the tolerance (Tol) or, as in the example shown in FIG. 4*b*, the command signal 600 ends. If the capacitor voltage falls below $V_{capp}$–(Tol), the ECM 210 will discontinue the second control signal 630 and produce the first control signal 620, as described above. In this manner, the solenoid driver circuit 200 will reduce the capacitor voltage when it exceeds the desired voltage level $V_{capp}$ and will charge the capacitor 330, increasing its voltage, when it falls below $V_{capp}$–(Tol).

Because the preferred embodiment of the present invention uses the battery voltage 270 to supply current to the solenoid coil 230 during the modulation of the current between the third predetermined level $I_3$ and the fourth predetermined current level $I_4$ and because the current created by back EMF is used to charge the high voltage capacitor 330, the system 200 is able to maintain the voltage of the high voltage capacitor 330 at a desired level. The desired level is preferably a higher voltage than the battery 270 voltage to achieve improved response time and improved repeatability.

Figure 5:
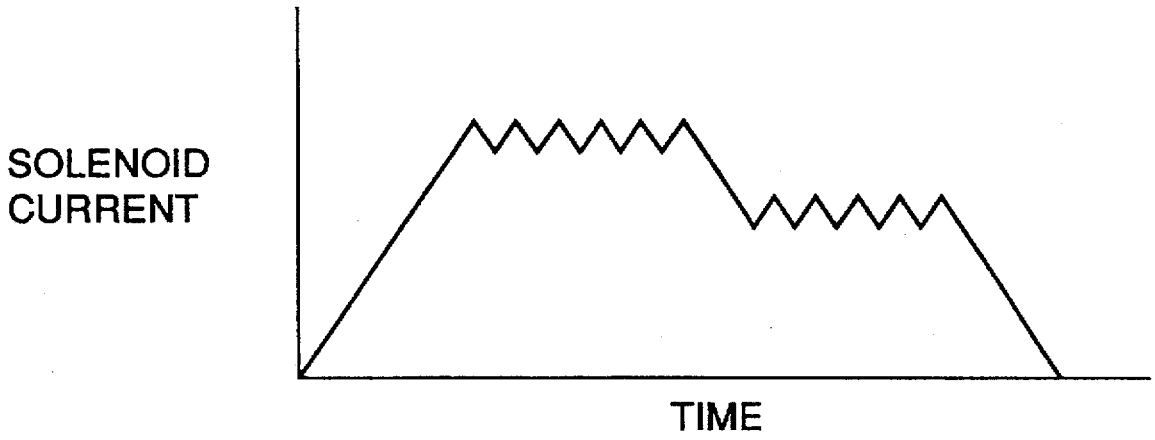
FIG. 5 illustrates a general two-tier current waveform used in connection with solenoid actuators.

The present invention can be used to control solenoid current to achieve other waveforms. For example, by varying the voltage level of the command signal, the solenoid driver circuit 200 can be used to control a two-tier current waveform as generally shown in FIG. 5.

In some applications, it may be necessary to drive two current waveforms of relatively short duration in quick succession. In those cases, the length of time that the battery 270 voltage is modulated across the solenoid coil 230 may be insufficient to recharge the capacitor to the desired level $V_{capp}$. In these instances it is possible to charge the capacitor 330 to a second desired voltage level $V_{cap2}$, which is higher than the desired voltage level $V_{capp}$. Then, the capacitor 330 voltage will fall when applied across the solenoid coil 230 to drive the first current waveform. The capacitor 330 will be briefly recharged when the battery voltage is modulated across the solenoid coil 230, to about the desired level $V_{capp}$. By precharging the capacitor 330 in this fashion, the preferred embodiment of the present invention can drive such waveforms.

We claim:

1. A driver circuit, comprising:

a solenoid coil;

a high voltage select switch having an open and a closed position;

a capacitor connected to said high voltage select switch and to ground;

a modulation switch connected in series with the solenoid, said modulation switch having an open and a closed position;

a current sensor connected to said modulation switch and to ground, said current sensor producing a current signal;

a select switch connected to the solenoid coil, said select switch having an open and a closed position;

a low voltage supply connected to said select switch;

a diode connected between said modulation switch and said capacitor; and a voltage sensor associated with said capacitor, said voltage sensor producing a voltage signal responsive to a voltage level of said capacitor;

an electronic controller connected to said voltage sensor and, said current sensor;

wherein said electronic controller receives said voltage and said current signal, and selectively produces a first control signal associated with said select switch in response to a current command signal, wherein said first control signal causes said select switch to close;

wherein said electronic controller selectively produces a second control signal associated with said high voltage select switch in response to said current command, voltage and current signal, wherein said second control signal causes said high voltage select switch to close;

said electronic controller selectively produces a third control signal associated with said modulation switch in response to said current command, voltage and current signal, wherein said third control signal causes said modulation switch to close.

2. The apparatus according to claim 1, wherein said current command signal corresponds to a predetermined current level and said electronic controller selectively produces said first, second and third control signals to control current through said solenoid coil to a level responsive to said predetermined current level.

3. The apparatus according to claim 2, including:

sensors connected to said electronic controller;

wherein said electronic controller calculates a current command signal based on inputs from said sensors.

4. The apparatus according to claim 1, wherein:

said electronic controller monitors said voltage of said high voltage capacitor and in response to said voltage being less than a desired voltage, said electronic controller produces said first and third control signal in response to said command signal;

said electronic controller produces a command signal corresponding to first predetermined current level;

said electronic controller thereafter discontinues said third control signal in response to said current signal exceeding said first predetermined current level:

said electronic controller thereafter alternatively produces and discontinues said third control signal until said voltage exceeds said desired voltage.

5. The apparatus according to claim 4, wherein:

said electronic controller discontinues said third control signal in response to said current signal being less than a second predetermined current level.

6. The apparatus according to claim 1, wherein:

said electronic controller produces said second and third control signals in response to a current command signal;

said electronic controller discontinues said second and third control signals in response to said current signal exceeding a third predetermined current level, wherein said third predetermined current level is a function of said current command signal; and said electronic controller thereafter produces said first control signal and alternatively produces and discontinues said third control signal in response to said current signal falling below a fourth predetermined level, and said current signal exceeding said first predetermined level, respectively, thereby maintaining a current level through said solenoid coil within a predetermined tolerance of a current level corresponding to said command current signal.

7. The apparatus according to claim 1, wherein:

said electronic controller produces said second and third control signals in response to a current command signal;

said electronic controller discontinues said second and third control signals in response to said current signal exceeding a third predetermined level, wherein said third predetermined level is a function of said current command signal; and said electronic controller thereafter produces said first control signal and alternatively produces said third control signal in response to expiration of a first predetermined time period after said third signal is discontinued, and discontinues said third control signal in response to said current signal exceeding said third predetermined level, respectively, thereby maintaining a current level through said solenoid coil within a predetermined tolerance of a current level corresponding to said command current signal.

8. The apparatus according to claim 1, wherein said electronic controller begins an injection sequence in response to a fuel injection current command signal, said injection sequence including:

said electronic controller produces said second control signal associated with said high voltage select switch and said third control signal associated with said modulation switch until said current signal is greater than a third predetermined current level;

said electronic controller discontinues said second control signal associated with said high voltage select switch and produces said first control signal in response to said current signal being greater than a first predetermined level;

said electronic controller alternatively discontinues and produces said third control signal associated with said modulation switch in response to said current signal being greater that said third predetermined level and less than a fourth predetermined current level, respectively.

9. An apparatus according to claim 1, wherein:

said electronic controller produces said second and third control signals in response to a current command signal;

said electronic controller discontinues said second and third control signals in response to said current signal exceeding a third predetermined level, wherein said third predetermined level is a function of said current command signal; and said electronic controller thereafter produces said first control signal and alternatively produces said third control signal in response to a first predetermined time period after said third signal is discontinued, and discontinues said third control signal in response to said current signal exceeding said third predetermined level, respectively, thereby maintaining a current level through said solenoid coil within a predetermined tolerance of a current level corresponding to said command current signal;

said electronic controller discontinues said first control signal and produces said second control signal in response to the voltage level across said capacitor exceeding a desired voltage level; and said electronic controller produces said first control signal and discontinues said second control signal in response to the voltage level across said capacitor falling below a predetermined tolerance value of the desired voltage.

10. An apparatus according to claim 1, wherein:

said electronic controller produces said second and third control signals in response to a current command signal;

said electronic controller discontinues said second and third control signals in response to said current signal exceeding a third predetermined level, wherein said third predetermined level is a function of said current command signal; and said electronic controller thereafter produces said first control signal and alternatively produces and discontinues said third control signal in response to the current through said solenoid coil falling below a fourth predetermined current level and rising above a third predetermined current value, respectively, thereby maintaining a current level through said solenoid coil within a predetermined tolerance of a current level corresponding to said command current signal;

said electronic controller discontinues said first control signal and produces said second control signal in response to the voltage level across said capacitor exceeding a desired voltage level; and said electronic controller produces said first control signal and discontinues said second control signal in response to the voltage level across said capacitor falling below a predetermined tolerance value of the desired voltage.

11. A method for controlling a fuel injector solenoid driver, said solenoid driver including connecting a high voltage capacitor to a solenoid coil in response to receiving a current command signal;

disconnecting said capacitor from said solenoid in response to current through said solenoid exceeding a predetermined level;

connecting a low voltage source to said solenoid in response to said current falling below a second predetermined level;

disconnecting said low voltage source from said solenoid in response to said current through said solenoid exceeding said predetermined level; and charging said capacitor with energy created in the solenoid coil inductance as a result of both of said steps of disconnecting.

* * * * *